United States Patent [19]

Grazen

[11] 4,373,933

[45] Feb. 15, 1983

[54] METHOD OF PRODUCING PRECISION ABRASIVE TOOLS

[76] Inventor: Alfred E. Grazen, 368 S. Main St., Deep River, Conn. 06417

[21] Appl. No.: 264,132

[22] Filed: May 15, 1981

[51] Int. Cl.[3] ..... C09C 1/68

[52] U.S. Cl. ..... 51/309; 29/527.1; 51/307; 264/255; 264/311; 204/4; 204/9

[58] Field of Search ..... 51/309, 307; 264/255, 264/311; 204/4, 9

[56] References Cited

U.S. PATENT DOCUMENTS

| | | | |
|---|---|---|---|
| 2,505,196 | 4/1950 | Mays | 51/309 |
| 2,820,746 | 1/1958 | Keeleric | 51/309 |
| 3,129,269 | 4/1964 | Charvat | 264/311 |
| 3,785,938 | 1/1974 | Sam | 51/309 |
| 4,211,294 | 7/1980 | Multakh | 51/309 |

*Primary Examiner*—James H. Derrington
*Attorney, Agent, or Firm*—Alan E. Steele

[57] ABSTRACT

A method of producing long life precision abrasive articles for use in metal removal operations. In this method abrasive particles are impinged against the inner surfaces of a rotating cylindrical mold by centrifugal force. During rotation of the mold a metallic matrix is deposited electrolytically on the inner surfaces of the mold until a matrix supporting the abrasive particles is formed. The matrix is then removed to receive core material and the core is then machined to the finished dimensions. The method is carried out at low temperatures, thereby avoiding heat distortion of the end product.

10 Claims, 3 Drawing Figures

FIG. 1
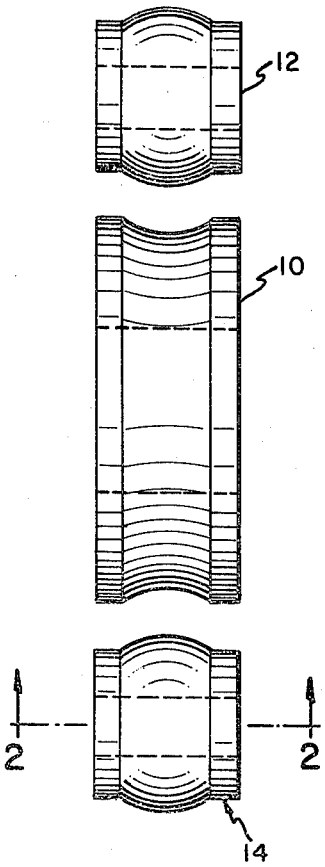
FIG. 2
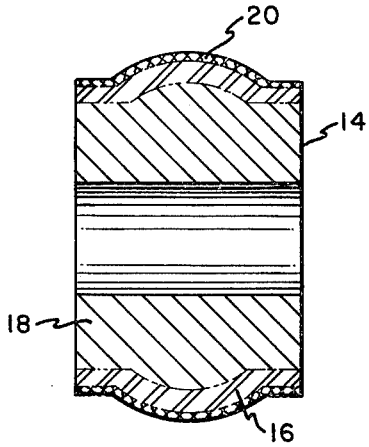
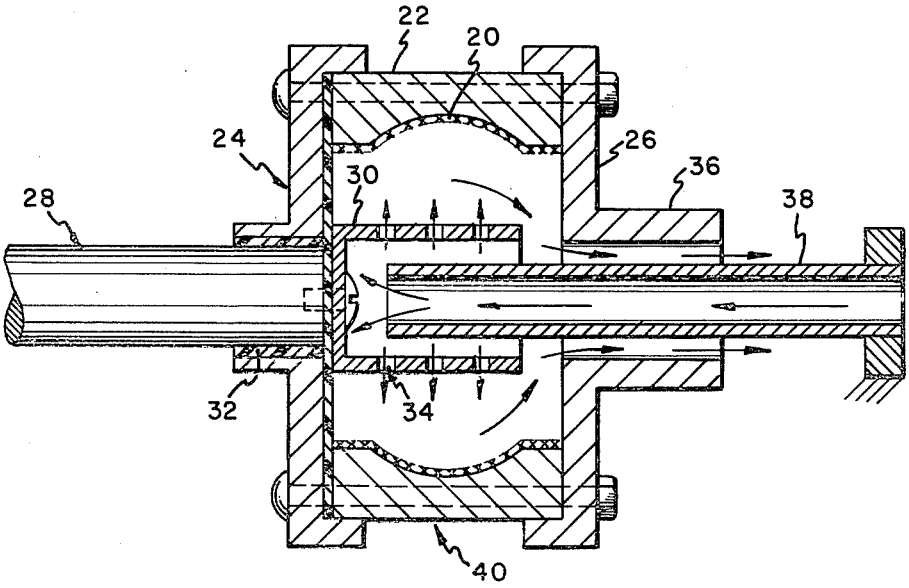
FIG. 3

METHOD OF PRODUCING PRECISION ABRASIVE TOOLS

This invention relates to a method of producing abrasive tools used in metal removal operations. Although this method can be used with abrasives such as diamonds, silicons, oxides, carbides, nitrides or other hard metals, this specification shall use diamonds in the preferred embodiment of the invention.

Diamond dressing rolls have been produced for many years by prior art that requires hand setting of diamonds onto a machined mold and then sintering in a nickel silver and tungsten alloy at temperatures of 2000° F. This alloy provides a matrix for the diamond particles and a hub or core for mounting the roll onto the diamond dresser spindle. This procedure is time consuming, and the high temperature of sintering causes distortion which must be subsequently corrected by grinding and lapping of the diamond surfaces. Such grinding and lapping results in the loss of free cutting diamond points and creates a dull surface which effects a certain amount of crush dressing. This causes higher spindle deflection, vibration and horsepower requirements. The degree of crush dressing effected is proportioned to the amount of surface area represented by the diamond particles which are ground or lapped to a face geometry which conforms to the dresser roll surface. Further, the relatively high temperature of sintering also aggravates diamond flaws and may cause rupture and premature errosion.

It is an object of this invention to provide a simple method of producing abrasive tools.

Another object of this invention is to provide an economical process, for producing abrasive tools, at low temperatures to prevent distortion.

A more specific object of this invention is to provide a simple and economic method of producing high precision diamond abrasive tools.

With this and other objects in view as will hereinafter become apparent, the method of my invention is described herein in the production of a high precision diamond dressing roll. In making this diamond dressing roll, a mold is formed which has the precise geometry of the dressing wheel circumferance. This mold has loose diamond particles introduced into it and then the mold is rotated. As the mold rotates an electrolyte is introduced into the mold and through electro-deposition a matrix of metal envelops the diamond particles. The metal in the electrolytic solution can be selected from the group consisting of nickel, copper, iron, tin and silver. Since the diamond particles and the electrolyte are thrown against the internal mold surface a matrix of metal with diamond particles is formed on this mold surface. For the purpose of economy, the cycle of rotation and electro-deposition is stopped after a predetermined time and the excess diamond particles are removed. The electro-deposition is then resumed until a matrix of sufficient thickness is formed which is structurally sound. When this is achieved the electro-deposition is stopped and the matrix is removed from the mold. Core material is then introduced into the matrix. The core material can be a plastic or ceramic which hardens at room temperature. When the core material solidifies the sides of the matrix are machined and a hole is drilled thus finishing the diamond dressing roll. The temperatures of the electrolyte and electrodeposition may range from room temperature up to 200° F. After removal of the matrix from the mold a certain amount of matrix material is etched away slightly to expose more fully the diamond particle cutting edges.

Other features and many of the attendant advantages of this invention will be readily appreciated as the invention becomes better understood from the following description taken in connection with the illustrative embodiments in the accompanying drawings wherein:

FIG. 1 shows the relationship of the dressing wheel, grinding wheel and the part being ground;

FIG.2 shows an enlarged section through the dressing wheel; and

FIG. 3 illustrates a mold and fixture used in the method of making the diamond dressing wheel.

Referring now to the drawings, and initially in FIG. 1 there is seen two wheels and a part being formed. Wheel 10, is the grinding wheel which forms the part 12, and wheel 14 is the dressing wheel which dresses the grinding wheel 10 when the grinding wheel becomes somewhat worn and cannot grind part 12 within the required tolerances. FIG. 2 is an enlarged portion of a section through dressing wheel 14 showing the contours of the wheel, the core 18, and the matrix 16 and its surface which have the abrasive diamond particles 20.

The mold fixture assembly 40 for making the dressing wheel 14 is shown in FIG. 3. The mold 22 can be made of various materials, as shown here it is made of aluminum and is bolted to end caps 24 and 26. End cap 24 is made of metal and is press fit on shaft 28. It is insulated from shaft 28 and anodic distributor 30 by a plastic material 32, such as bakelite. End cap 26 is made of a plastic material. An electrolyte inlet tube 38 carries electrolyte from a pump, not shown, into the mold fixture assembly 40 and into an electrolyte distributor 30 located inside the mold fixture assembly. The distributor 30 is attached to shaft 28 by a screw and is thereby electrically coupled to the shaft. Anodic distributor 30 has holes 34 located around its sides as shown in FIG. 3. Shaft 28 receives a positive charge from an energy source, not shown, and end cap 24 receives a negative charge from a source, not shown. Since the shaft 28 is electrically coupled to the anodic distributor 30, the distributor 30 receives the same positive charge. Similarly since mold 22 is in contact with end cap 24 it receives a negative charge. In order for electrolytic deposition to take place the level of the electrolyte in the mold must be in contact with anodic distributor 30. Therefore the diameter of anodic distributor 30 must be greater than the internal diameter of collar 36.

The matrix 16 of the dressing wheel 14 is made by the following process. Diamond particles 20 are put into the mold fixture assembly 40 and the mold fixture assembly 40 is rotated by shaft 28. Shaft 28 is driven by a motor not shown. As the mold fixture assembly rotates the diamond particles are thrown against and dispersed against the inner surface of mold 22 by centrifugal force. An electrolyte containing a metal is then introduced through tube 38 into distributor 30 and then into the mold fixture assembly. Due to the positive charge on anodic distributor 30 and the negative charge on mold 22, electrolytic deposition of metal takes place on mold 22. This deposition begins to form matrix 16 which envelops the diamond particles 20 from the inner surface of mold 22 inward toward the distributor 30. At this point, one may for reasons of economy stop the process and by removing end cap 26, remove the excess diamond particles which have not been captured by the matrix. After the excess diamond particles have been removed, end cap 26 is replaced and the process resumed. At this time it may not be necessary to continue rotation of the mold since the diamond particles are in place. One may continue electrolytic deposition at this time in the manner he desires. The electrolytic deposition continues until a matrix 16 of suitable thickness is achieved. This thickness may vary from 0.0001" for very small particles to 0.5". The electrolyte is returned to a sump, not shown, from the mold fixture assembly through an annular opening formed by the collar 36 of end cap 26 and the outer surface of tube 38, see arrows for directions of flow. Once the desirable matrix thickness is achieved the electrolytic deposition is stopped, and all power to the mold is shut down. The end caps 24 and 26 are removed, thereby allowing one to remove the mold 22 with its matrix 16 and diamond particles 20 adhering to the mold. A suitable core material 18 is then assembled into the mold 22. The core is then machined to size and the axial portion is drilled out to desired size.

The mold 22 is then removed either by mechanical means of turning or grinding, or by chemical means by dissolution in acid or alkali solutions. In our preferred embodiment of using an aluminum mold, this can be chemically expended by dissolution in a caustic solution.

Once the mold 22 is removed one may wish to better expose the cutting edges of the diamond particles. This can be achieved by etching away a portion of the outer surface of the matrix either chemically or electrochemically with acids or alkalis. In our preferred embodiment, the metallic matrix can be etched away with nitric acid or aqua-regia. The cutting edges of the diamond particles 20 may also be exposed by a blasting operation where the abrasive material such as sand, silicon carbide or aluminum oxide is used.

Having thus described my invention and advantages thereof, it will be understood that the foregoing disclosure relates not only to preferred embodiments of the invention, but it is also intended to cover all changes and modifications of the invention selected for the purpose of disclosure without departing from the true spirit and scope thereof.

I claim:

1. A method of making a precision abrasive tool, which comprises (a) depositing loose diamond particles in a metallic mold having an inner annular surface in an amount which is in excess of the number of particles needed to cover the inner annular surface of said mold.

(b) rotating said mold about its horizontal axis to spread said diamond particles evenly over the inner annular surface of said mold by centrifugal force rotating means, (c) distributing by an electrolytic distributing means an electrolytic solution containing a metal into the rotating mold, (1) wherein the mold annular surface has a negative charge forming a cathode.

(2) wherein the electrolytic solution distributing means has a positive charge forming an anode.

(d) forming a solidified matrix of metal by electrolytic deposition around the diamond particles on the inner annular surface of said mold, (e) removing the diamond particles which are not contained within said matrix, (f) continuing the buildup of the matrix to the desired thickness by electrolytic deposition, (g) removing the mold from the rotating means, and introducing core material into the mold as backup for said matrix, (h) machining the core material to desired dimensions, (i) separating the mold from said matrix with the diamond particles and core material.

2. A method as set forth in claim 1 wherein the metal in the electrolytic solution is selected from the group consisting of nickel, copper, iron, tin or silver.

3. A method as set forth in claim 1 wherein the matrix thickness falls in the range of 0.0001" to 0.5".

4. A method as set forth in claim 1 wherein the temperature of electrolytic deposition may range from room temperature to 200° F.

5. A method as set forth in claim 1 wherein the core material is a plastic or ceramic which hardens at room temperature.

6. A method as set forth in claim 1 wherein the mold is made from materials other than metals.

7. A method as set forth in claim 1 wherein the mold is separated from the matrix by means of chemical dissolution in an acid or alkali solution.

8. A method as set forth in claim 1 wherein the surface of the matrix after said matrix has been separated from the mold is etched to further expose the cutting edges of the diamond particles.

9. A method as set forth in claim 8 wherein the etching is performed chemically with acids or alkalis.

10. A method of making a precision abrasive tool, which comprises (a) depositing abrasive particles in a hollow mold having an inner annular surface, (b) distributing said abrasive particles on said inner annular surface by rotating said mold by centrifugal force rotating means, (c) introducing an electrolytic solution containing a metal into the rotating mold, (d) forming a solidified matrix of metal by electrolytic deposition around the abrasive particles on the inner annular surface of said mold, (e) removing the abrasive particles which are not contained within said matrix, and (f) continuing the buildup of the matrix to the desired thickness by electrolytic deposition, (g) removing the mold from the rotating means, and introducing core material into the mold as backup for said matrix, (h) machining the core material to desired dimensions, (i) separating the mold from said matrix with the diamond particles and core material.

* * * * *